US009974348B2

(12) United States Patent
Wilkins-Gaudio

(10) Patent No.: US 9,974,348 B2
(45) Date of Patent: May 22, 2018

(54) DISCREET ELASTIC BELT

(71) Applicant: Leslie Wilkins-Gaudio, Armonk, NY (US)

(72) Inventor: Leslie Wilkins-Gaudio, Armonk, NY (US)

( * ) Notice: Subject to any disclaimer, the term of this patent is extended or adjusted under 35 U.S.C. 154(b) by 252 days.

(21) Appl. No.: 14/554,215

(22) Filed: Nov. 26, 2014

(65) Prior Publication Data

US 2015/0181965 A1 Jul. 2, 2015

Related U.S. Application Data

(63) Continuation of application No. 13/785,419, filed on Mar. 5, 2013, now abandoned, which is a continuation of application No. 12/072,132, filed on Feb. 22, 2008, now Pat. No. 8,393,016.

(60) Provisional application No. 60/902,627, filed on Feb. 22, 2007.

(51) Int. Cl.
*A41F 9/00* (2006.01)
*A41F 9/02* (2006.01)

(52) U.S. Cl.
CPC ..... *A41F 9/00* (2013.01); *A41F 9/002* (2013.01); *A41F 9/02* (2013.01)

(58) Field of Classification Search
CPC .... A41F 9/00; A41F 9/002; A41F 9/02; A41F 9/025; A41F 11/12; A41F 13/00
USPC ..... 2/312, 317, 321, 338
See application file for complete search history.

(56) References Cited

U.S. PATENT DOCUMENTS 1,156,835 A * 10/1915 Butts ..... A41F 11/16 2/317
1,233,834 A * 7/1917 Baumann ..... A41F 9/002 2/301
1,373,123 A * 3/1921 Ferguson ..... A41F 11/16 2/317
1,448,399 A * 3/1923 Graf ..... A41F 11/16 2/317
1,514,726 A * 11/1924 Prentice ..... A41F 11/16 139/397
1,796,049 A * 3/1931 Rood ..... A41F 11/16 2/314
1,801,839 A * 4/1931 Balaban ..... A41F 11/16 2/314
1,908,038 A * 5/1933 MacKenzie ..... A41F 9/002 2/321
2,002,946 A * 5/1935 Jacobs ..... A44B 11/28 2/321
2,417,332 A * 3/1947 Veitch ..... A41F 11/02 2/316
2,513,886 A 7/1950 Mix
2,596,884 A 5/1952 Bailen
2,849,723 A * 9/1958 Marino ..... A41F 15/005 2/323

(Continued)

*Primary Examiner* — Alissa L Hoey
(74) *Attorney, Agent, or Firm* — Sorell Lenna & Schmidt, LLP

(57) ABSTRACT invention relates to clothing support devices, and more particularly, discreet belts that support clothing, such as trousers, skirts, or the like, around a waist of a user. Provided is a discreet belt that includes a belt body formed from a flexible, elongated elastic strap adapted to be used in at least one fastening element and at least one adjusting element. Various embodiments, variants and method aspect are also provided.

20 Claims, 4 Drawing Sheets

(56) References Cited

U.S. PATENT DOCUMENTS 2,895,480 A * 7/1959 Fixel ..... A41F 11/00 450/111
2,896,220 A 7/1959 Kenny
3,806,997 A * 4/1974 Niwa ..... A44B 9/16 24/709.9
4,894,868 A * 1/1990 Christopher ..... A41D 27/26 2/268
4,985,937 A * 1/1991 Blackburn ..... A41F 9/002 2/308
5,023,956 A 6/1991 Fox
5,046,197 A 9/1991 Chernuchin et al.
5,063,615 A 11/1991 Chernuchin et al.
5,245,707 A * 9/1993 Green ..... A41D 27/136 2/54
5,600,852 A * 2/1997 Densch ..... A41D 25/005 2/144
5,797,145 A 8/1998 Levinson
5,797,171 A 8/1998 Nelson
5,873,133 A * 2/1999 Jurga ..... A41F 9/002 2/322
6,056,625 A * 5/2000 Fildan ..... A41F 15/002 2/336
6,056,626 A * 5/2000 Fildan ..... A41F 15/002 2/336
6,125,792 A * 10/2000 Gee ..... A47D 13/046 119/770
6,155,906 A * 12/2000 May ..... A41F 15/002 450/1
6,179,687 B1 1/2001 Lee et al.
6,206,752 B1 3/2001 Fagin et al.
6,368,180 B1 * 4/2002 Dailey ..... A41C 3/12 2/300
6,481,528 B2 * 11/2002 Antonio ..... A45F 3/14 182/3
6,513,224 B1 * 2/2003 Chen ..... A41F 9/002 2/322
6,547,636 B1 * 4/2003 Cato ..... A41C 3/0078 450/86
6,656,013 B1 * 12/2003 Wang ..... A41F 15/002 2/244
6,839,916 B1 * 1/2005 Chen ..... A41F 9/002 2/322
7,232,359 B1 6/2007 Richardson
D578,732 S * 10/2008 Samuels ..... D2/639
D578,733 S * 10/2008 Samuels ..... D2/639
8,393,016 B2 * 3/2013 Wilkins-Gaudio ..... A41F 9/002 2/312
D687,194 S * 7/2013 Reed ..... D30/152
2001/0052145 A1 * 12/2001 Srivastava ..... A41F 1/00 2/312
2002/0046715 A1 * 4/2002 McCarville ..... A01K 27/009 119/858
2002/0157172 A1 10/2002 Matsushima et al.
2003/0217703 A1 * 11/2003 Kiss ..... A46B 7/04 119/863
2004/0187194 A1 * 9/2004 Gilliam ..... A41F 3/02 2/340
2005/0039244 A1 2/2005 Goldfarb et al.
2006/0117465 A1 * 6/2006 Willows ..... A45F 5/02 2/338
2006/0218690 A1 10/2006 James
2006/0230504 A1 10/2006 Razzaghi et al.
2007/0107670 A1 * 5/2007 Pampena ..... A01K 27/009 119/858
2008/0190980 A1 * 8/2008 Overton ..... A45F 3/14 224/664
2010/0083414 A1 * 4/2010 Hunt ..... A41F 19/00 2/16
2010/0235967 A1 * 9/2010 Janakus ..... A41F 9/025 2/311
2016/0286763 A1 * 10/2016 Durrant ..... A01K 27/001

* cited by examiner

DISCREET ELASTIC BELT

CROSS-REFERENCE TO RELATED APPLICATIONS

This application claims the benefit of U.S. Provisional Patent Application No. 60/902,627, filed Feb. 22, 2007, U.S. application Ser. No. 12/072,132, filed Feb. 22, 2008, now allowed, and U.S. application Ser. No. 13/785,419, filed Mar. 5, 2013 the entirety of all applications is incorporated herein by reference.

TECHNICAL FIELD

The present invention is directed to clothing support devices, and more particularly, belts that are discreet and may be used to stretchably support a clothing article while being worn around a waist of a user.

BACKGROUND

Traditional or conventional belts, usually constructed with a buckle mechanism and other hardware, can provide garment support. However, for certain applications, aesthetic, fashion, and fit issues may arise that highlight the limitations of conventional belts for such applications. For example, in many situations, conventional belts have too much, or too little, material left after adjustments, and users are left with the fit and fashion problems.

Many times, users have to balance the fit of a belt with the fashion look the user desires. Conventional belt buckles, hardware, holes, excessive material, or the like create and/or contribute to fit and fashion problems. When trying to figure out how to deal with fit problems of conventional belts, users may have to pull conventional belts too tight thereby ruining the fashion look the users desire to achieve. Typically, users want to prevent clothing problems, such as, trousers that gap in the back, pants that fall down exposing undergarments, pants that slip down repeatedly, and the like. Even though users may consider comfortable fit and outfit support when deciding to employ conventional belts, many users do not want to employ conventional belts that would ruin the desired fashion look of the outfit. Typically, users want to maintain outfit support, comfortable fit, and fashion look.

In other situations, body shape or figure of users can create issues with certain articles of clothing. For instance, people with large physical posteriors and small waists can have a difficult time finding clothing to fit their body shapes. As a result, people in such a situation have to buy larger sizes to accommodate their body shape even though the waistline of the garment is larger than necessary for the waist of those potential belt users. In other situations, physical medical issues, such as scoliosis or the like, prevent garments from fitting without additional support. Traditional or conventional belts do not provide enough support in these situations, particularly where conventional belts can not be adjusted properly to allow a user to wear clothing with comfort.

The inventors have recognized that when dealing with the fashion problems of conventional belts, belt users have to deal with bulges underneath clothing. There are many times when a user requires the support of a belt but does not want to wear a traditional or conventional belt with hardware, buckles, holes, excessive material, or the like since such components of a belt interfere with the user's outfit fashion look. Typically, when a user puts on a traditional or conventional belt, the user has to feed the end of a strap through a buckle which can leave extra material at the end of the belt which adds more bulk to a person's outfit. When wearing an outfit where a shirt will go over the waist of the bottom garment, a conventional belt, with a buckle or other hardware, may bulge under the shirt. For those users who consider fit and fashion of an outfit of clothing when deciding on belt choice, bulge or too much thickness can ruin the fit and/or the fashion look the user is trying to achieve.

Another problem with conventional belts occurs when such belts lack fashion design, such as colors, patterns, graphic designs, different widths, or the like. When considering a belt to use with an outfit, a user may find that conventional belts are inadequate to supplement a fashion look for garments.

The inventors recognized that there is a need for a discreet, in certain situations, barely visible to virtually invisible, adjustable belt for supporting clothing around a waist of a user which can be customized and/or adjusted as the user desires.

In one aspect, there is provided a discreet belt for a clothing article, the belt including:

a belt body formed from a flexible, elongated, elastic strap;

at least one fastening element operably connected to the belt body, wherein the at least one fastening element is adapted to releasably close the belt around an outer surface of the clothing article; and at least one adjusting element operably connected to the belt body, wherein the adjusting element is adapted to increase and/or decrease a length of the belt body so that the belt may be tightened and/or loosened around an outer surface of the clothing article to secure the clothing article to a waist of a user. Various embodiments and variants are provided.

In an embodiment, there is provided a discreet belt for a clothing article, the belt including:

a belt body having a first terminal end and a second terminal end, the belt body being formed by a flexible, elongated, thermoplastic strap, the strap being transparent, semi-transparent or opaque;

a first clasp operably attached to the first terminal end of the belt body and a second clasp operably attached to the second terminal end of the belt body, the clasps adapted to be releasably fastened to one another to close the belt around an outer surface of the clothing apparel; and two cinch buckles operably connected to the belt body, wherein the cinch buckles are adapted to increase and/or decrease a length of the belt body so that the belt may be tightened and/or loosened around an outer surface of the clothing article to secure the clothing article to a waist of a user. Various embodiments and variants are provided.

In another aspect, there is provided a method of improving a fit between a clothing article and a waist of a wearer, the method including providing the wearer with a discreet belt that includes:

a belt body formed from a flexible, elongated, plastic strap;

at least one fastening element operably connected to the belt body, wherein the at least one fastening element is adapted to releasably close the belt around the outer surface of the clothing article; and at least one adjusting element operably connected to the belt body, wherein the adjusting element is adapted to increase and/or decrease the length of the belt body so that said belt may be tightened and/or loosened around the outer surface of the clothing article to secure the clothing article to the waist of the wearer; whereby enabling the wearer to control the fit between the clothing article and the wearer's waist by tightening and/or loosening said belt. Various embodiments and variants are provided.

Other features will become clearer from the detailed description in conjunction with the accompanying drawings.

BRIEF DESCRIPTION OF THE DRAWINGS

For the purposes of illustrating the various aspects of the invention, wherein like numerals indicate like elements, there are shown in the drawings simplified forms that may be employed, it being understood, however, that the invention is not limited by or to the precise arrangements and instrumentalities shown, but rather only by the claims. The drawings may not be to scale, and the aspects of the drawings may not be to scale relative to each other. To assist those of ordinary skill in the relevant art in making and using the subject matter hereof, reference is made to the appended drawings and figures, wherein:

DETAILED DESCRIPTION

The terms used in the claims are hereby defined as follows.

The term "belt body" denotes all components of the discreet belt described herein except fastening and adjusting elements. The belt body is formed from a flexible, elongated, plastic strap, but may include additional structural and/or design elements. The term "elastic" with respect to the "strap" described herein denotes a unit that upon being stretched creates a tension force in the direction opposite to the direction of stretching. When the discreet belt is closed, this tension force may be directed toward the waist of the wearer, pulling the clothing article closer in. The term "secure" may or may not denote keeping the clothing article on, but does denote the existence of the tension force.

The term "fastening element" denotes a structural unit that is adopted to fasten one portion of the belt body to another.

The term "adjusting element" denotes a structural unit that is adopted to adjust the length of the belt body.

Discreet belts are disclosed herein for securing an article of clothing apparel around a waist of a user. The belts may be employed to secure garments, such as, but not limited to, trousers, skirts, dresses, shorts, or the like.

In particular, while the invention is not limited by any specific theory, one area of application for discreet belts disclosed herein is worth specific mention. The inventors have recognized that clothing wearers often desire to improve the fit between a clothing article and the waist. Whether or not such improvement relates to improved support, clothing wearers may wish to bring the clothing article closer to the waist, for example, to minimize exposure of the undergarments. This may be particularly true with jeans, which often have bulging excess of material around the waist, especially apparent when the wearer is seated. The inventors also recognized that fashion belts are not usually suitable to address this issue, as their design often more concerned with appearance rather than functionality.

Figure 1:
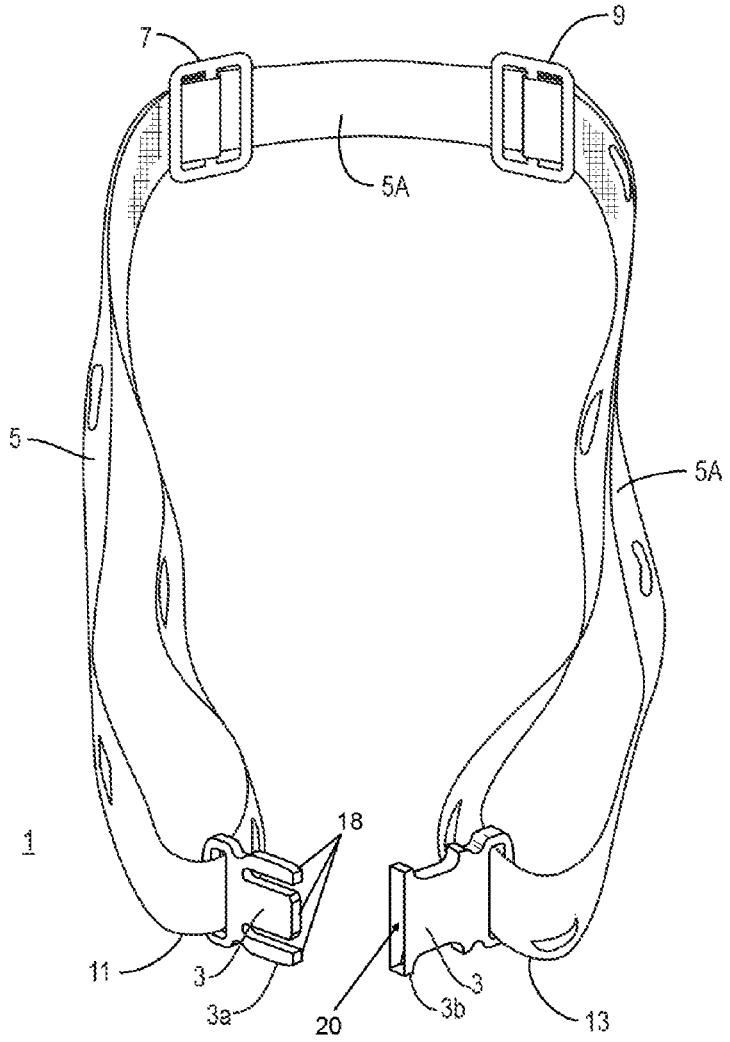
FIG. 1 is a partially perspective view of the discreet belt in accordance with at least one aspect of the present invention.

FIG. 1 is a partially perspective view of an embodiment of a discreet belt 1 in accordance with at least one aspect of the present invention. The discreet belt 1 includes at least one fastening element 3, a belt body 5 formed from a strap 5A, and at least one adjusting element 7.

Those skilled in the art will recognize that any type of clear, translucent, transparent, semi-transparent, or opaque material may be used to make the strap 5A, which is a flexible, elongated, plastic unit from which the belt body 5 is formed.

Preferably, the strap 5A is made of thermoplastic polymer, for example, polyurethane, and is stretchable and elastic, thus permitting the belt 1 to have tension when it is wore. The material used for strap 5A may be as soft as needed to give the belt 1 the desired flexibility, stretch, and/or elasticity and as hard as needed to maintaining support and tension for the clothing. To improve the invisible look of belt 1, the belt body 5 lies flat against a waist of a user. In some embodiments, the width of strap 5A may vary over the length for fit and fashion of a user. In a preferred embodiment, belt 1 is made from thermoplastic polyurethane polymer to provide a secure fit that clings well to garments. In other embodiments, belt 1 may comprise other materials to offer more variety and decorative options while maintaining the same support as with clear thermoplastic polyurethane polymer material. In accordance with at least one embodiment, the belt 1 may be made in different lengths and widths.

Figure 3:
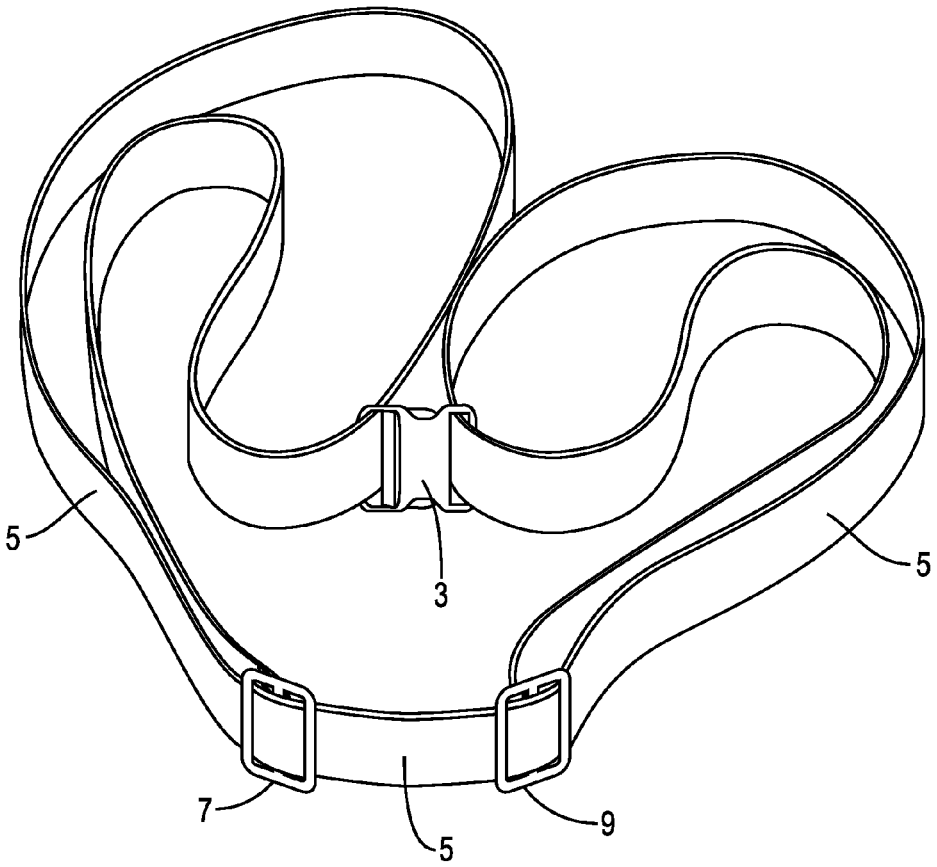
FIG. 3 is a partially perspective view of a closed discreet belt in accordance with at least one aspect of the present invention.
Figure 4:
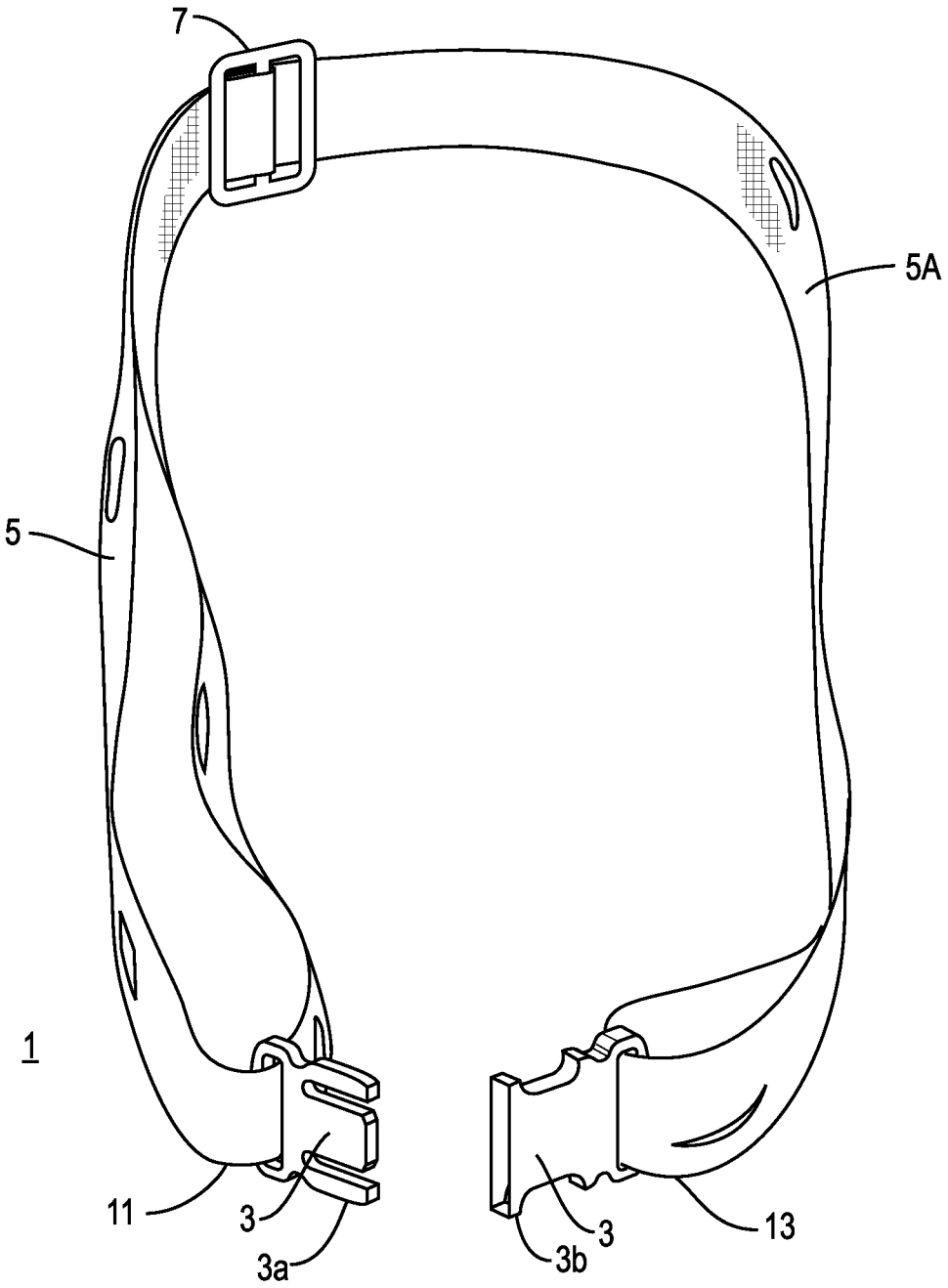
FIG. 4 is a partial perspective view of the discreet belt in accordance with at least one aspect of the present invention.

As set forth above, the belt 1 includes at least one fastening element 3. Any fastening element suitable for releasably closing the belt 1 around a waist of a user may be included. With reference to FIG. 1, the belt 1 may include two fastening elements 3*a*, 3*b*, which are operably connected to terminal ends 11, 13 of belt body 5, respectively. The user of the discreet belt 1 releasably connects fastening element 3*a* to fastening element 3*b* to close the belt 5, e.g., as shown in FIG. 3. Fastening element 3*a* defines a male member or fastener, such as, for example, a male fastening element and fastening element 3*b* defines a female member or fastener, such as, for example, a female fastening element. The male fastening element defines a first half configured for disposal in a complimentary shaped second half of the female fastening element. In one embodiment, the male fastening element comprises spaced apart extensions 18 and the female fastening element comprises a cavity 20 configured for disposal of extensions 18. In one embodiment, the male fastening element comprises three spaced apart extensions 18, as shown in FIG. 1, for example.

In accordance with at least one embodiment, fastening element(s) 3 of the belt 1 preferably lies flat against the waist of a user. This eliminates the need for traditional or conventional belt buckles, which are bulky and may negatively impact the fit and/or fashion of clothing apparel. However, a user may wear traditional or conventional belts and/or buckles over the discreet belt 1 to supplement the fashion look of the outfit if desired. Those skilled in the art will recognize that any type of fastening element 3 may be used to secure belt 1 to a user, such as, but not limited to, a clasp, a closure buckle, a clip, a fastener, or the like. Fastening element 3 may be worn underneath clothing loops or may be worn in front of or around a waist of a user. Those skilled in the art will further recognize that fastening element 3 may comprise any type of material to give the belt the appearance of invisibility, such as, but not limited to, clear plastic, suitable polymer, which may be injection molded, polyurethane polymer, thermoplastic polyurethane polymer, or the like. Fastening element 3 may comprise other textile materials to offer more variety and decorative options while maintaining the same support as with clear thermoplastic polyurethane polymer material.

In accordance with a broad aspect of the present invention, at least one adjusting element 7 is operably connected to a belt body 5. The adjustability provides an accurate and custom fit for the user. In accordance with at least one preferred embodiment, two symmetrically designed adjustment elements 7, 9 are provided at substantially equal distances from fastening elements 3*a*, 3*b*, respectively. Adjusting elements 7, 9 are adapted to increase and/or decrease the length of belt body 5A around a waist of a user so a user may adjust the fit and fashion look of discreet belt 1. The adjusting elements 7, 9 allow the user to personalize the fit in accordance with the support needed or desired. In accordance with at least one embodiment, adjusting elements 7, 9 lie flat against the waist of a user. Any type of adjusting element 7, 9 may be used to adjust the belt 1 around a waist of a user, such as, but not limited to, a cinch buckle, an adjustor, or the like. The adjusting elements 7, 9 may comprise any type of material to give the belt the appearance of invisibility, such as, but not limited to, clear plastic, suitable polymer, which may be injection molded, polyurethane polymer, thermoplastic polyurethane polymer, or the like. Adjusting elements 7, 9 may comprise other textile materials to offer more variety and decorative options while maintaining the same support as with clear thermoplastic polyurethane polymer material.

Respective terminal ends 11, 13 of the belt body 5 may originate at, and are coupled to, the fastening element 3. In accordance with at least one preferred embodiment, respective ends of strap 5 may loop (loops shown in FIG. 3) through at least one fastening element 3*a*, 3*b* and connect to at least one respective adjusting element 7, 9. When a user adjusts a belt 1 with adjusting elements 7, 9, the length of the belt 1 changes accordingly. As the length of the belt 1 changes, fastening elements 3*a*, 3*b* of fastening element 3 shift along strap 5. Once fastening elements 3*a*, 3*b* relocate along strap 5, the new locations on respective ends of strap 5 are respective terminal ends 11, 13. Where one adjusting element 7 (or 9) is used on a discreet belt 1, terminal end 13 (or 11) of strap 5 can remain the same while the position of terminal end 11 (or 13) shifts when a user adjusts the length of strap 5. Those skilled in the art will recognize how to adjust adjusting elements 7, 9. In at least one embodiment, a user adjusts the length of a belt 1 by holding the belt 1 close to an adjusting element 7 with a thumb and forefinger of a first hand. With a second hand, the user gently pulls the strap 5 through the adjusting element 7 at a downward angle to lengthen or shorten the belt. A user may then repeat the adjustment on any other adjusting element 9 until the desired customizable support is reached.

Once a user adjusts the belt 1 as desired, a user puts the belt 1 through clothing loops and clasps the belt together. A user may push the belt down to a base of a waistband if desired for support. Those skilled in the art will recognize how to put a belt 1 through waist loops of clothing, such as, but not limited to, pant loops, trouser loops, shorts loops, dress loops, skirt loops, or the like. In other embodiments, a user may wear a belt 1 for clothing without loops.

Figure 2:
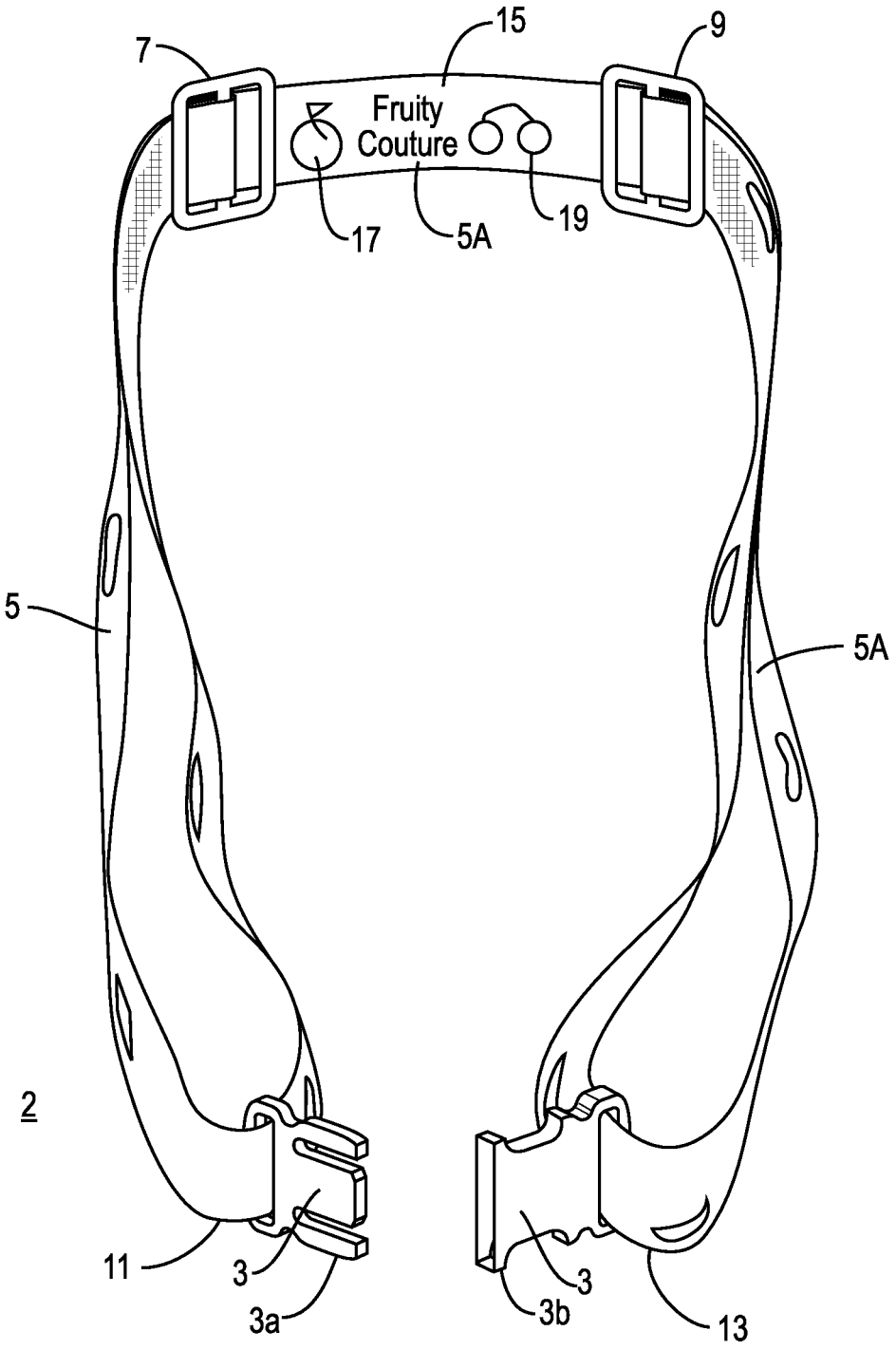
FIG. 2 is a partially perspective view of the discreet belt with graphical designs in accordance with at least one embodiment of the present invention.

Reference is now made to FIG. 2, which is a partially perspective view of a discreet belt 2 with text 15 and graphical designs 17, 19. Those skilled in the art will recognize that users can supplement a fashion look of an outfit with attached belt designs, such as, but not limited to, different textures, text, designs, graphical designs, colors, patterns, different widths, attached embellishments, finishes, appliques, or the like. Belt 2 may be manufactured with attached text 15 or graphical designs 17, 19 for a more fashionable statement. Text 15 and designs 17, 19 may be added to belt 2 after initial manufacture of the belt as well.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A discreet belt for a clothing article, the belt comprising:

an elongated strap made from a thermoplastic polymer and extending between a first end and a second end; and a single adjusting element fixedly connected with the first end and being slidably connected to the elongated strap thereby forming a loop, wherein the single adjusting element is configured for uninterrupted movement along a length of the elongated strap from a female fastening element to a male fastening element to increase and/or decrease the length of the elongated strap such that the belt is configured to be tightened and/or loosened around an outer surface of the clothing article to secure the clothing article around a waist of a user, the female fastening element being directly connected to the loop of the elongated strap and the male fastening element being directly connected to the elongated strap, wherein the male fastening element defines a first half configured for disposal in a complimentary shaped second half of the fastening element so as to close the belt around the outer surface of the clothing article.

2. The discreet belt as recited in claim 1, wherein the elongated strap is semi-transparent, transparent, opaque, textile material, or a combination thereof.

3. The discreet belt as recited in claim 1, wherein the elongated strap is stretchable.

4. The discreet belt as recited in claim 1, wherein said thermoplastic polymer is polyurethane.

5. The discreet belt as recited in claim 1, wherein the first fastening element is made of a hard plastic.

6. The discreet belt as recited in claim 1, wherein the first adjusting element is made of a hard plastic.

7. The discreet belt of claim 1, wherein the female fastening element is a clasp, a closure buckle, or a clip.

8. The discreet belt as recited in claim 1, wherein the single adjusting element is a cinch buckle.

9. The discreet belt as recited in claim 1, wherein the clothing article is pants.

10. The discreet belt as recited in claim 1, wherein the elongated strap is transparent.

11. The discreet belt as recited in claim 1, wherein the single adjusting element is a buckle.

12. The discreet belt as recited in claim 1, wherein the single adjusting element is an adjustor.

13. The discreet belt as recited in claim 1, wherein the single adjusting element comprises a clear plastic material, the male fastening element comprising spaced apart extensions configured for disposal in a cavity of the female fastening element.

14. The discreet belt as recited in claim 1, wherein the single adjusting element comprises a clear thermoplastic polyurethane polymer material.

15. A belt comprising:

an elongated strap made from a thermoplastic polymer and extending between a first end and a second end; and a single adjusting element fixedly connected with the first end and being slidably connected to the elongated strap thereby forming a loop, wherein the single adjusting element is configured for uninterrupted movement along a length of the elongated strap from a first fastening element to a second fastening element to increase and/or decrease the length of the elongated strap such that the belt is configured to be tightened and/or loosened around an outer surface of a clothing article to secure the clothing article around a waist of a user, the first fastening element being directly connected to the loop of the elongated strap, the first fastening element being a female fastener, the second fastening element being directly connected to the elongated strap, wherein the second fastening element is a male fastener defining a first half configured for disposal in a complimentary shaped second half of the first fastening element so as to close the belt around the outer surface of the clothing article.

16. The belt of claim 15, wherein the male fastener includes spaced apart extensions configured for disposal in a cavity of the female fastener.

17. The belt of claim 15, wherein the first fastening element includes a magnet and the second fastening element is attachable to the magnet.

18. The belt of claim 15, wherein the elongated strap is transparent.

19. The belt of claim 15, wherein the clothing article is pants.

20. A belt comprising:

an elongated strap made from a thermoplastic polymer and extending between a first end and a second end; and a single adjusting element fixedly connected with the first end and being slidably connected to the elongated strap thereby forming a loop, wherein the single adjusting element is configured for uninterrupted movement along a length of the elongated strap from a first fastening element to a second fastening element to increase and/or decrease the length of the elongated strap such that the belt is configured to be tightened and/or loosened around an outer surface of a clothing article to secure the clothing article around a waist of a user, the first fastening element including a first end and a second end, the second end of the first fastening element including an opening configured to receive the elongate strap therethrough such that the first fastening element is directly connected to the loop of the elongated strap, the first fastening element being a female fastener, the second fastening element including a first end and a second end, the second end of the second fastening element including an opening configured to receive the elongate strap therethrough such that the second fastening element is directly connected to the elongated strap, the second fastening element being a male fastener, wherein the second fastening element defines a first half comprising three spaced apart extensions that are configured for disposal in a complimentary shaped second half of the first fastening element so as to close the belt around the outer surface of the clothing article.

* * * * *